US009070994B2

(12) United States Patent
Tajima

(10) Patent No.: US 9,070,994 B2
(45) Date of Patent: Jun. 30, 2015

(54) PLUG, ELECTRONIC APPARATUS, AND PLUG RECEPTACLE

(71) Applicant: Sony Corporation, Tokyo (JP)

(72) Inventor: Shigeru Tajima, Kanagawa (JP)

(73) Assignee: Sony Corporation, Tokyo (JP)

( * ) Notice: Subject to any disclaimer, the term of this patent is extended or adjusted under 35 U.S.C. 154(b) by 270 days.

(21) Appl. No.: 13/713,919

(22) Filed: Dec. 13, 2012

(65) Prior Publication Data

US 2013/0178089 A1 Jul. 11, 2013

(30) Foreign Application Priority Data

Jan. 11, 2012 (JP) ..... 2012-003236

(51) Int. Cl.

| | |
|---|---|
| ***H01R 29/00*** | (2006.01) |
| ***H01R 31/00*** | (2006.01) |
| ***H01R 13/428*** | (2006.01) |
| ***H01R 13/00*** | (2006.01) |
| ***H01R 13/703*** | (2006.01) |

(52) U.S. Cl.

CPC ..... *H01R 13/428* (2013.01); *H01R 29/00* (2013.01); *H01R 13/00* (2013.01); *H01R 31/00* (2013.01); *H01R 13/7038* (2013.01)

(58) Field of Classification Search

USPC ..... 439/188, 189, 489, 272, 588, 587, 274, 439/275, 76.1, 76.2, 652, 620, 852, 949, 439/359, 361–364, 548, 549, 550

See application file for complete search history.

(56) References Cited

U.S. PATENT DOCUMENTS

| | | | | |
|---|---|---|---|---|
| 3,913,046 | A * | 10/1975 | Davis et al. | 337/13 |
| 4,120,552 | A * | 10/1978 | Winkler et al. | 439/95 |
| 7,566,232 | B2 * | 7/2009 | Iida | 439/145 |
| 2006/0110957 | A1 * | 5/2006 | Lekic et al. | 439/131 |
| 2010/0277846 | A1 * | 11/2010 | Koshin et al. | 361/101 |
| 2011/0312199 | A1 * | 12/2011 | Alrutz et al. | 439/188 |

FOREIGN PATENT DOCUMENTS

| | | |
|---|---|---|
| JP | 2001-306191 | 11/2001 |
| JP | 2008-123051 | 5/2008 |

* cited by examiner

*Primary Examiner* — Abdullah Riyami
*Assistant Examiner* — Harshad Patel
(74) *Attorney, Agent, or Firm* — Sony Corporation

(57) ABSTRACT

There is provided a plug which includes electrodes that transmit direct-current power and an electrode cover that covers the electrodes. The electrode cover includes a lock detection unit that electrically detects that the electrode cover is locked.

7 Claims, 12 Drawing Sheets

PLUG, ELECTRONIC APPARATUS, AND PLUG RECEPTACLE

CROSS REFERENCES TO RELATED APPLICATIONS

The present application claims priority to Japanese Priority Patent Application JP 2012-003236 filed in the Japan Patent Office on Jan. 11, 2012, the entire content of which is hereby incorporated by reference.

BACKGROUND

The present disclosure relates to a plug, an electronic apparatus, and a plug receptacle.

An alternating current is generated in a power plant to generate power and the alternating current is transmitted through a power line. The alternating current is converted into a direct current in an adapter or an electronic apparatus and is then used. However, the direct current is preferably supplied to the electronic apparatus, in terms of efficiency. Therefore, technology relating to direct-current power supply has developed.

Recently, with a surge of a power demand, power generation using natural energy such as solar power generation or wind power generation has attracted attention. However, because power generated by a solar battery is a direct current, after the direct current is converted into an alternating current, the alternating current should be converted into the direct current again, and this is inefficient. Therefore, supply of the direct-current power becomes more important in the future.

A power supply bus system in which a power supply block to supply power to an apparatus such as a battery or an AC adapter and a power consumption block receiving the power from the power supply block are connected to one common bus line for a direct current has been suggested (for example, refer to JP 2001-306191A and JP 2008-123051A). In such a power supply bus system, the direct current flows through the bus line. In the power supply bus system, the individual blocks are described as objects and the objects of the individual blocks mutually exchange information (state data) through the bus line. The object of each block generates information (state data) on the basis of a request from the object of the other block and transmits the information as reply data. The object of the block that has received the reply data can control supply or consumption of power, on the basis of the content of the received reply data.

SUMMARY

Different from the alternating current, when the direct-current power is supplied, if a plug is removed from a plug receptacle, it is likely to generate arc. If the arc is generated, various problems occur because it is difficult to remove the arc. For this reason, technology for providing a lock mechanism in a plug in an apparatus receiving the direct current to prevent the plug from being removed from a plug receptacle during power supply or providing a semiconductor switch in the plug to remove the plug without generating arc has been suggested.

However, a method according to the related art has been suggested quite independently from the power supply bus system and there are large insufficient points as the plug used in a power supply system.

It is desirable to provide a plug, an electronic apparatus, and a plug receptacle that enable electric detection of a connection state, when an apparatus is connected to a power line supplied with direct-current power.

According to an embodiment of the present disclosure, there is provided a plug which includes electrodes that transmit direct-current power and an electrode cover that covers the electrodes. The electrode cover includes a lock detection unit that electrically detects that the electrode cover is locked.

According to such a configuration, the electrodes transmit the direct-current power and the electrode cover covers the electrodes. The lock detection unit that is included in the electrode cover electrically detects that the electrode cover is locked to the plug receptacle including the lock mechanism after the electrode cover is completely inserted into the plug receptacle. As a result, the plug can electrically detect a connection state, when an apparatus is connected to a power line supplied with the direct-current power.

According to another embodiment of the present disclosure, there is provided an electronic apparatus which includes the plug.

According to another embodiment of the present disclosure, there is provided a plug receptacle which includes electrodes that transmit direct-current power and an electrode cover that covers the electrodes. The electrode cover includes a lock detection mechanism that makes the plug electrically detect that a plug including a lock detection unit is locked to the electrode cover after the plug is completely inserted into the electrode cover.

According to the embodiments of the present disclosure described above, a plug, an electronic apparatus, and a plug receptacle that enable electric detection of a connection state, when an apparatus is connected to a power line supplied with direct-current power, can be provided.

Additional features and advantages are described herein, and will be apparent from the following Detailed Description and the figures.

DETAILED DESCRIPTION

Figure 1:
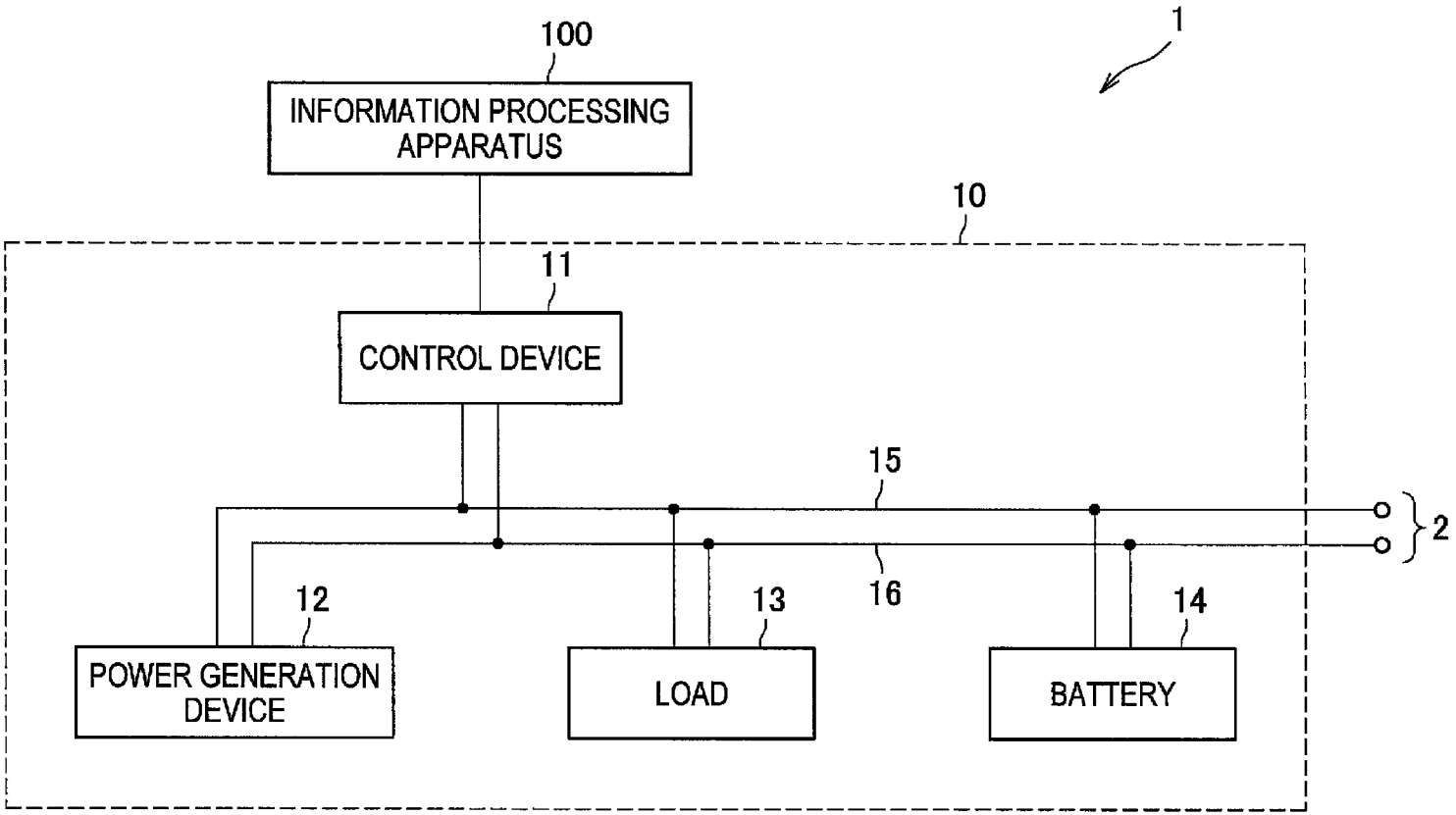
FIG. 1 is a diagram illustrating a configuration of a power supply bus system 1 according to a first embodiment of the present disclosure.

Hereinafter, preferred embodiments of the present disclosure will be described in detail with reference to the appended drawings. Note that, in this specification and the appended drawings, structural elements that have substantially the same function and structure are denoted with the same reference numerals, and repeated explanation of these structural elements is omitted.

The following description will be made in the order described below.

<1. Technical Background>
<2. First Embodiment>
<3. Second Embodiment>
<4. Third Embodiment>
<5. Fourth Embodiment>
<6. Fifth Embodiment>
<7. Application Example>
<8. Conclusion>

1. TECHNICAL BACKGROUND

First, before describing the preferred embodiments of the present disclosure in detail, the technical background of the present disclosure will be simply described. Then, the preferred embodiments of the present disclosure will be described in detail.

In direct current feeding, when an energy storage device such as a battery is connected to a power line, it is important to form an electrode of a connection plug to have an appropriate shape. That is, because the energy storage device such as the battery performs charging and discharging, when the plug is provided at the side of the energy storage device, if the electrode of the plug is a male electrode, a short circuit may be generated due to electrodes formed of foreign metals. Therefore, a female electrode is preferably provided at the side of the energy storage device. In this case, however, a plug receptacle side becomes a male electrode and power appears in the male electrode when charging is performed. As a result, the short circuit may be generated, similar to the case described above.

This is because the energy storage device is a power supply source and is a device receiving power. Therefore, it is not preferable to use a pair of a plug having an exposed male electrode and a plug receptacle, in direct current feeding. At the time of non-connection, a plug and a plug receptacle of which an electrode is protected by an insulating material are considered.

A power system that includes a power generator in which power is generated by natural energy, a transmission/distribution line receiving power from the power generator, a control device controlling power supply, a power storage device storing power from the power generator, and a load receiving power from the power generator or the power storage device and consuming the power may become further important and valid in realizing local power generation using natural energy or power management in the future.

When various apparatuses are connected to the transmission/distribution line in the power system, it is preferable to use the plug and the plug receptacle of which the electrode is protected by the insulating material at the time of non-connection, from the reason described above. Meanwhile, in the power system, the control device controls a local distribution network (a power network and a signal network to which the power generator, the power storage device, and the load are connected). That is, the control device executes recognition of the apparatuses connected to the local distribution network, control of power transmitted to the apparatuses, and control of power transmitted from the apparatuses and a power system called a local smart micro grid can be configured.

In the power system, when the apparatuses are connected to the transmission/distribution line, a lock mechanism performing locking at the time of connection and a connection detection mechanism electrically detecting connection are included in the plug, safety is improved, and apparatus control by the control device becomes easy.

In the power system, on the assumption the direct-current power is supplied, even though connection or non-connection by the plug is electrically detected by the connection detection mechanism, if a plug is removed suddenly from a plug receptacle, it is likely to generate arc. If the arc is generated, various problems occur because it is difficult to remove the arc. For this reason, technology for providing a lock mechanism in a plug in an apparatus receiving the direct current to prevent the plug from being removed from a receptacle during power supply or providing a semiconductor switch in the plug to remove the plug without generating arc has been suggested.

However, a method according to the related art has been suggested quite independently from the power supply bus system and there are large insufficient points as the plug used in a power supply system. That is, even though the lock mechanism is provided, a lock state may not be electrically known or electric connection release may not be known in the semiconductor switch.

Therefore, in the preferred embodiments of the present disclosure to be described below, a plug including a lock mechanism performing locking at the time of connection and a connection detection mechanism electrically detecting a lock state and an electric apparatus including the plug will be described.

2. FIRST EMBODIMENT

Configuration Example of System

First, a configuration example of a power supply bus system according to a first embodiment of the present disclosure will be described. FIG. 1 is a diagram illustrating a configuration of a power supply bus system 1 according to the first embodiment of the present disclosure. Hereinafter, the configuration of the power supply bus system 1 according to the first embodiment of the present disclosure will be described using FIG. 1.

As illustrated in FIG. 1, the power supply bus system 1 according to the first embodiment of the present disclosure includes a cell 10 that is a minimum unit of generation and consumption of power. The cell 10 includes a control device 11, a power generation device 12, a load 13, a battery device 14, a power line 15, and a communication line 16. The power line 15 forms a bus line 2 with the communication line 16.

The control device 11 executes power transmission/distribution control with respect to the power generation device 12, the load 13, and the battery device 14. The power transmission/distribution control that is executed by the control device 11 is not limited to a predetermined method. For example, the control device 11 executes control to determine supply timing of the power generated by the power generation device 12 or determine the priority of the power supply. The control device 11 executes communication using the communication line 16 between the power generation device 12, the load 13, and the battery device 14 and executes the power transmission/distribution control. Each of the power generation device 12, the load 13, and the battery device 14 has unique identification information, such that the control device 11 executes the power transmission/distribution control with respect to the power generation device 12, the load 13, and the battery device 14. The identification information may be unique information like a MAC address and may be information becoming unique in a predetermined range like an IP address.

The power generation device 12 that is a device to generate power of a predetermined specification is configured using a solar battery, a wind power generator, or a manual power generator. The power that is generated by the power generation device 12 may be direct-current power or alternating-current power. However, it is preferable to generate the direct-current power, in terms of efficiency. Note that it is assumed in the present disclosure that the power generated by the power generation device 12 is the direct-current power. The power that is generated by the power generation device 12 is supplied to the control device 11, the load 13, and the battery device 14 through the power line 15.

The load 13 is a device that consumes power of a predetermined specification generated by the power generation device 12. For example, the load 13 is configured using a general electric device. The load 13 receives the power generated by the power generation device 12 through the power line 15 and operates. The load 13 performs communication using the communication line 16 between the control device 11 and the load 13 and is subjected to the power transmission/distribution control by the control device 11.

The battery device 14 stores the power of the predetermined specification generated by the power generation device 12 or discharges the stored power. The battery device 14 receives the power generated by the power generation device 12 through the power line 15, under the control of the control device 11, and stores the power. The battery device 14 supplies the stored power through the power line 15, under the control of the control device 11.

A device supplied with the power generated by the power generation device 12 and a power supply time may be determined on the basis of the control of the control device 11. When the power is supplied on the basis of the control of the control device 11, a negotiation is performed by communication using the communication line 16 between the power generation device 12 and the device (for example, load 13) using the power, under the control of the control device 11. The control device 11 controls the power generation device 12 and the load 13, such that power of a specification desired by the load 13 is output from the power generation device 12 to the power line 15.

FIG. 1 shows a state in which the communication line 16 is provided separately from the power line 15. However, a function of the communication line 16 may be provided in the power line 15. The communication line 16 may be a line for wired communication. However, communication between the control device 11, the power generation device 12, the load 13, and the battery device 14 may be wireless communication.

Structures of a plug and a plug receptacle enabling safe connection and disconnection, when the battery device 14 is connected to the bus line 2 or is disconnected from the bus line 2, in the power supply bus system 1 that has the configuration described above, will be described.

[Configuration Example of Plug]

Figure 2A:
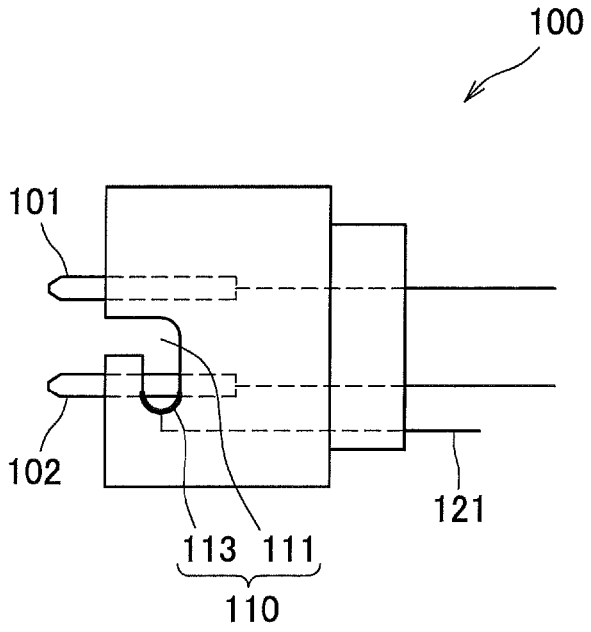
FIG. 2A is a diagram illustrating a structure of a plug 100.
Figure 2B:
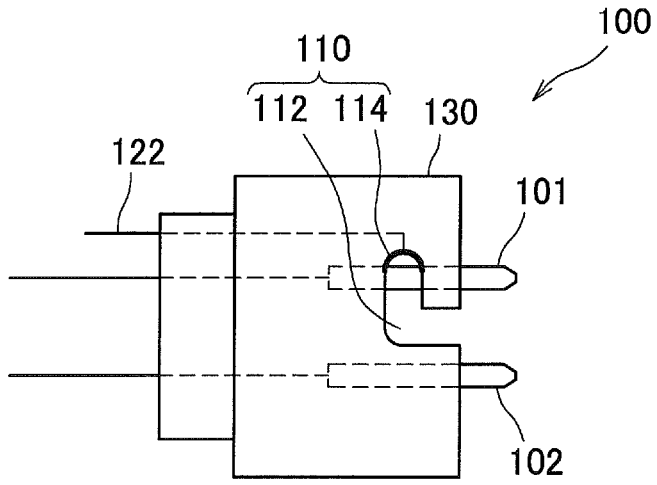
FIG. 2B is a diagram illustrating a structure of the plug 100.
Figure 2C:
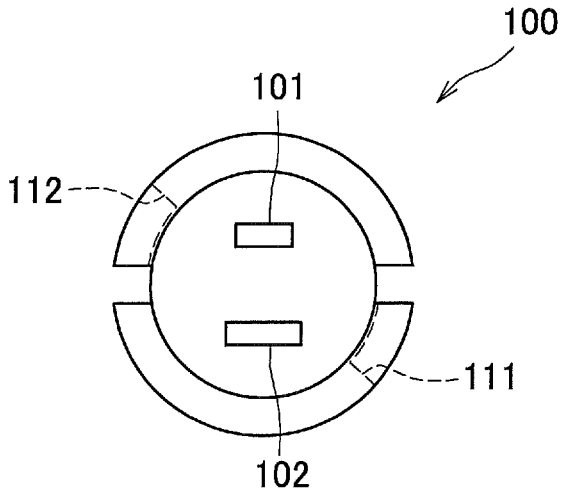
FIG. 2C is a diagram illustrating a structure of the plug 100.
Figure 3A:
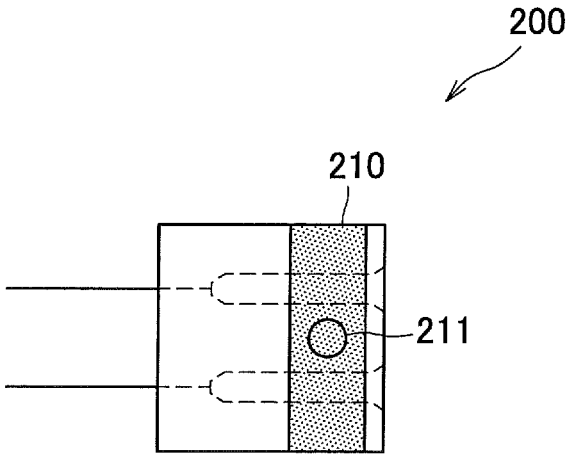
FIG. 3A is a diagram illustrating a structure of a plug receptacle 200 that is connected to the plug 100.
Figure 3B:
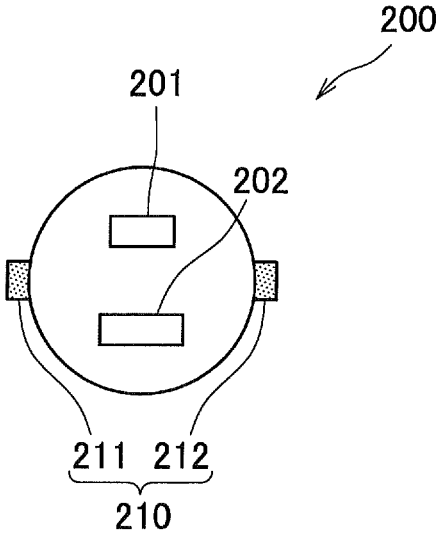
FIG. 3B is a diagram illustrating a structure of the plug receptacle 200 that is connected the plug 100.

FIGS. 2A to 2C are diagrams illustrating a structure of a plug 100 to connect the battery device 14 to the bus line 2. FIGS. 3A and 3B are diagrams illustrating a structure of a plug receptacle 200 that is provided in the bus line 2 and is connected to the plug 100.

FIG. 2A is a right view of the plug 100. FIG. 2B is a left view of the plug 100 and FIG. 2C is a front view of the plug 100.

As illustrated in FIGS. 2A to 2C, the plug 100 according to the first embodiment of the present disclosure includes electrodes 101 and 102, a lock mechanism 110, lock detection leading lines 121 and 122, and an electrode cover 130. The lock mechanism 110 includes lock grooves 111 and 112 and lock detection electrodes 113 and 114.

FIG. 3A is a left view of the plug receptacle 200. FIG. 3B is a front view of the plug receptacle 200. The right view of the plug receptacle 200 is a reversed view of the left view of the plug receptacle 200 illustrated in FIG. 3A.

As illustrated in FIGS. 3A and 3B, the plug receptacle 200 according to the first embodiment of the present disclosure includes electrodes 201 and 202, a lock mechanism 210, and an electrode cover 220. The lock mechanism 210 includes bosses 211 and 212.

In the power supply bus system 1, the power generation device 12 generates direct-current power. If the electrodes are misdirected, the apparatus abnormally operates. Therefore, as illustrated in the drawings, the sizes of the electrodes 101 and 102 and the electrodes 201 and 202 are changed, so that the plug 100 is prevented from being erroneously inserted into the plug receptacle 200.

The lock mechanism 110 of the plug 100 is formed of an insulating material such as plastic or rubber. The lock grooves 111 and 112 and the lock detection electrodes 113 and 114 are provided in a circumferential portion of the lock mechanism 110 to become symmetrical with respect to a point. The lock detection electrodes 113 and 114 are formed in a semi-circular arc shape, as illustrated in FIGS. 2A and 2B. The lock detection leading lines 121 and 122 extend from the lock detection electrodes 113 and 114.

The lock mechanism 210 of the plug receptacle 200 is formed of a conductive material. The bosses 211 and 212 are short-circuited by the conductive material.

Figure 4A:
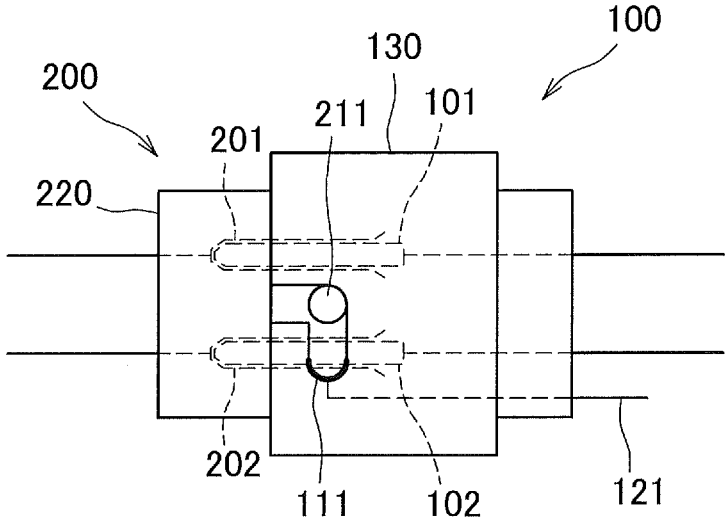
FIG. 4A is a diagram illustrating connection of the plug 100 and the plug receptacle 200.
Figure 4B:
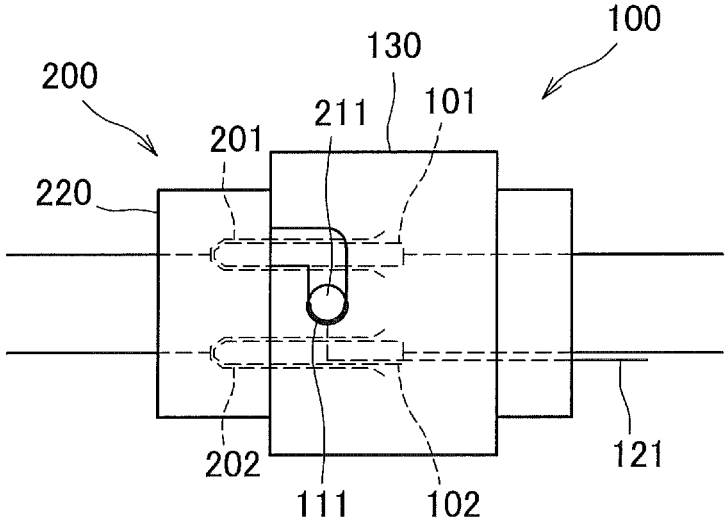
FIG. 4B is a diagram illustrating connection of the plug 100 and the plug receptacle 200.

Next, connection of the plug 100 and the plug receptacle 200 will be described. FIGS. 4A and 4B are diagrams illustrating connection of the plug and the plug receptacle 200.

First, as illustrated in FIG. 4A, the plug 100 is inserted into the plug receptacle 200 in a state in which the electrodes are aligned. However, when the plug 100 is only inserted into the plug receptacle 200, the log detection electrodes 113 and 114 do not contact the bosses 211 and 212.

After the plug 100 is inserted into the plug receptacle 200 in a state in which the electrodes are aligned, the lock mechanism 110 of the plug 100 is rotated in a clockwise direction. In this case, as illustrated in FIG. 4B, the lock detection electrodes 113 and 114 contact the bosses 211 and 212.

If the lock detection electrodes 113 and 114 contact the bosses 211 and 212, the lock detection electrodes 113 and 114 are short-circuited by the bosses 211 and 212. That is, the lock detection leading lines 121 and 122 are short-circuited. If the lock detection leading lines 121 and 122 are short-circuited, the battery device 14 can electrically detect that the plug 100 is normally connected to the plug receptacle 200.

Figure 5:
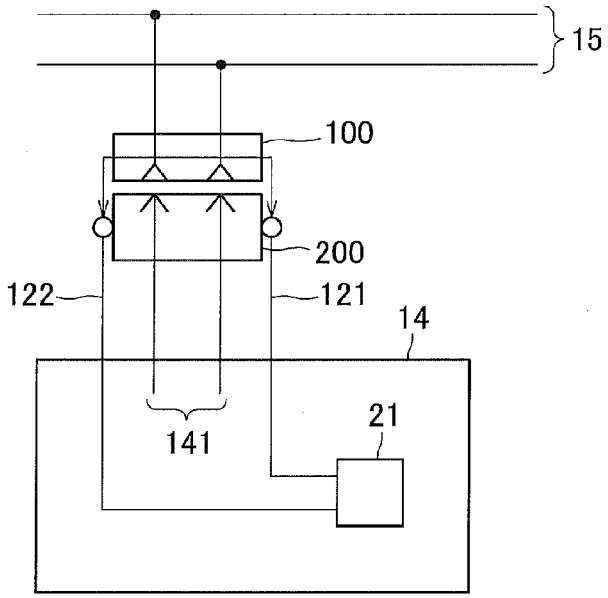
FIG. 5 is a diagram illustrating a configuration example of a battery device 14 that includes the plug 100 according to the first embodiment of the present disclosure.

In this case, an example of a configuration in which the battery device 14 electrically detects that the plug 100 is normally connected to the plug receptacle 200 will be described. FIG. 5 is a diagram illustrating a configuration example of the battery device 14 that includes the plug 100 according to the first embodiment of the present disclosure.

As illustrated in FIG. 5, the battery device 14 that includes the plug 100 according to the first embodiment of the present disclosure includes a microprocessor 21. The microprocessor 21 is connected to the lock detection leading lines 121 and 122. The battery device 14 includes a power line 141 to receive power from the power line 15.

If the plug 100 is not connected to the plug receptacle 200 and the lock detection leading lines 121 and 122 are not short-circuited, the microprocessor 21 may not electrically detect that the plug 100 is connected to the plug receptacle 200. For this reason, it can be determined that the plug 100 is not connected to the plug receptacle 200. Meanwhile, as described above, if the plug 100 is connected to the plug receptacle 200 and the lock detection leading lines 121 and 122 are short-circuited, the microprocessor 21 can electrically detect that the plug 100 is connected to the plug receptacle 200. For this reason, it can be determined that the plug 100 is connected to the plug receptacle 200.

The battery device 14 has the configuration illustrated in FIG. 5, so that the battery device 14 can electrically detect that the plug 100 is connected to the plug receptacle 200 and the control device 11 can receive a notification showing that a preparation for power reception by connection of the plug 100 is enabled. The battery device 14 has the configuration illustrated in FIG. 5, so that arc can be prevented from being generated when the plug 100 is inserted or removed.

3. SECOND EMBODIMENT

Configuration Example of Plug

In the first embodiment of the present disclosure described above, the configuration in which the lock mechanism 100 and the lock detection leading lines 121 and 122 are provided in the plug 100, the lock mechanism 210 is provided in the plug receptacle 200, and connection of the plug 100 and the plug receptacle 200 can be electrically detected has been described.

In the second embodiment of the present disclosure, the lock mechanism and the lock detection leading lines are provided in the plug, similar to the first embodiment. Then, a plug with a configuration in which a power supply line in the plug is supplied with electricity when the plug is connected to the plug receptacle and the power supply line in the plug is cut when the plug is removed from the plug receptacle will be described.

Figure 6:
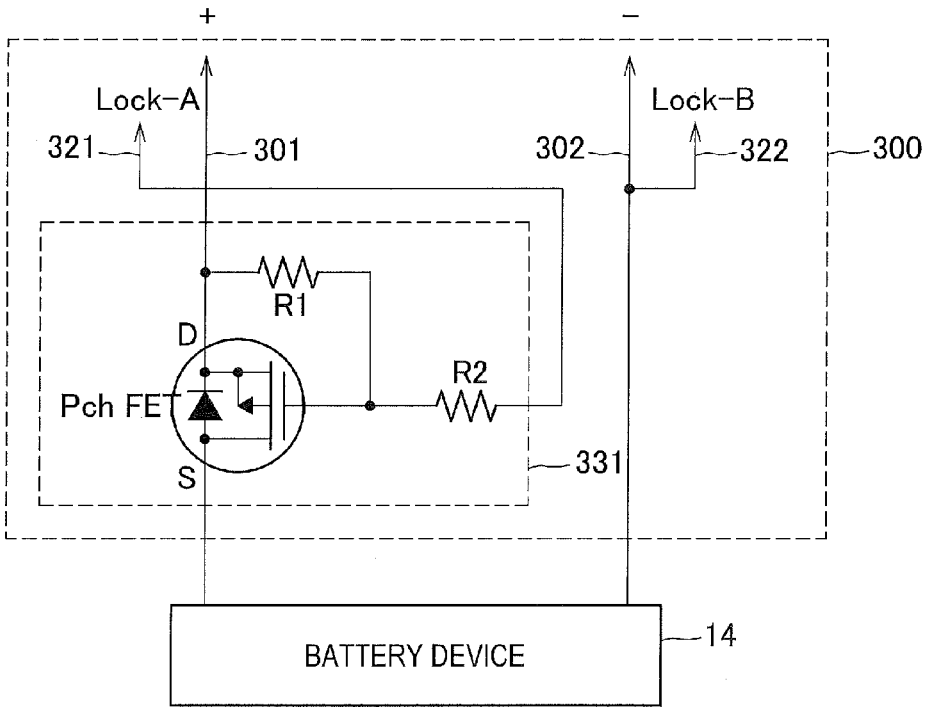
FIG. 6 is a diagram illustrating an internal configuration of a plug 300 according to a second embodiment of the present disclosure.

FIG. 6 is a diagram illustrating an internal configuration of a plug 300 according to the second embodiment of the present disclosure. Hereinafter, the internal configuration of the plug 300 according to the second embodiment of the present disclosure will be described using FIG. 6. Because the plug 300 may have an external shape equal to the plug 100 according to the first embodiment of the present disclosure, detailed explanation will be omitted.

As illustrated in FIG. 6, the plug 300 according to the second embodiment of the present disclosure includes electrodes 301 and 302, lock detection leading lines 321 and 322, and a semiconductor switch 331.

Similar to the electrodes 101 and 102 of the plug 100 according to the first embodiment of the present disclosure, the electrodes 301 and 302 have different shapes in a positive electrode and a negative electrode and have a function of preventing the plug 300 from being erroneously inserted into the plug receptacle.

Similar to the lock detection leading lines 121 and 122 of the plug 100 according to the first embodiment of the present disclosure, the lock detection leading lines 321 and 322 are opened when the plug 300 is not completely connected to the plug receptacle and are short-circuited when the plug 300 is completely connected to the plug receptacle.

The semiconductor switch 331 includes a P-channel field effect transistor (FET) and resistors R1 and R2. The semiconductor switch 331 is a switch that is turned off when the lock detection leading lines 321 and 322 are opened and is turned on when the plug 300 is completely connected to the plug receptacle and the lock detection leading lines 321 and 322 are short-circuited.

By this configuration, the plug 300 according to the second embodiment of the present disclosure can supply electricity to the power supply line in the plug 300 by turning on the semiconductor switch 331, when the plug 300 is connected to the plug receptacle. The plug 300 can cut the power supply line in the plug by turning off the semiconductor switch 331, when the plug 300 is removed from the plug receptacle.

If the plug 300 according to the second embodiment of the present disclosure has the configuration illustrated in FIG. 6, as described in the first embodiment of the present disclosure, even though the lock detection leading lines are not connected to the microprocessor in the device, the power supply line can be supplied with electricity or cut in the plug 300. Therefore, even when there is no power control mechanism in the device provided with the plug 300, safe connection to the bus line 2 and safe disconnection from the bus line 2 are enabled. As in the first embodiment of the present disclosure, the lock detection leading lines 321 and 322 may be connected to the microprocessor in the device.

4. THIRD EMBODIMENT

Configuration Example of Plug

In the first embodiment of the present disclosure described above, the example of the case in which the lock mechanism of the bayonet type illustrated in the drawings is used as the lock mechanism to lock the plug 100 and the plug receptacle 200 has been described. However, the lock mechanism to lock the plug and the plug receptacle is not limited to the example described above. In the third embodiment of the present disclosure, a configuration in which the plug and the plug receptacle are locked by a different method will be described.

Figure 7A:
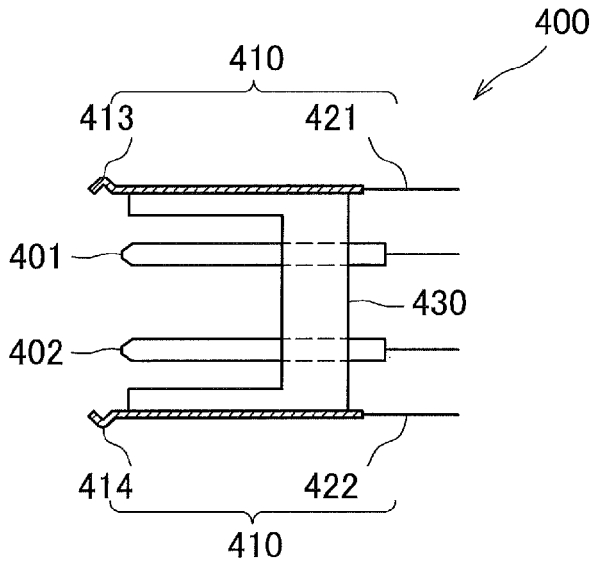
FIG. 7A is a diagram illustrating a structure of a plug 400.
Figure 7B:
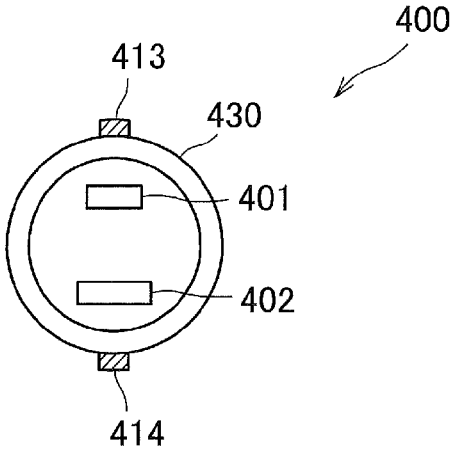
FIG. 7B is a diagram illustrating a structure of the plug 400.
Figure 8A:
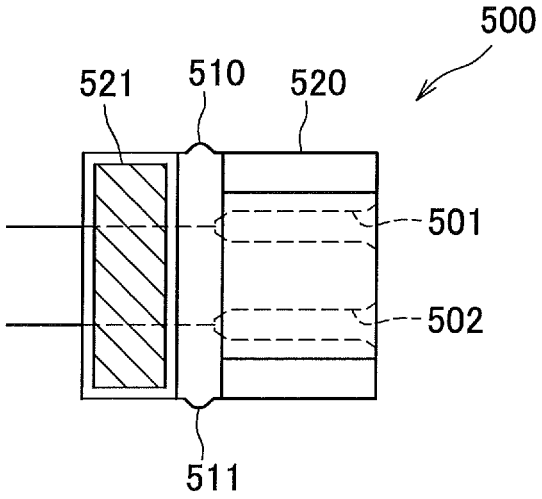
FIG. 8A is a diagram illustrating a structure of a plug receptacle 500 that is connected to the plug 400.
Figure 8B:
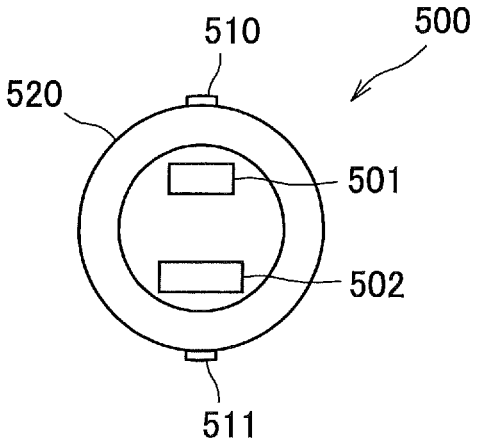
FIG. 8B is a diagram illustrating a structure of the plug receptacle 500 that is connected the plug 400.

FIGS. 7A and 7B are diagrams illustrating a structure of a plug 400 according to the third embodiment of the present disclosure. FIGS. 8A and 8B are diagrams illustrating a structure of a plug receptacle 500 that is provided in the bus line 2 and is connected to the plug 400.

FIG. 7A is a right cross-sectional view of the plug 400. FIG. 7B is a front view of the plug 400.

As illustrated in FIGS. 7A and 7B, the plug 400 according to the third embodiment of the present disclosure includes electrodes 401 and 402, a lock mechanism 410, and an electrode cover 430. The lock mechanism 410 includes lock detection spring electrodes 413 and 414 and lock detection leading lines 421 and 422.

FIG. 8A is a left cross-sectional view of the plug receptacle 500 and FIG. 8B is a front view of the plug receptacle 500.

As illustrated in FIGS. 8A and 8B, the plug receptacle 500 according to the third embodiment of the present disclosure includes electrodes 501 and 502, lock mechanisms 510 and 511, and an electrode cover 520 provided with an insulating material 521. The lock mechanisms 510 and 511 are formed of a conductive material. The conductive material is formed in the plug receptacle 500 to surround the lock mechanisms 510 and 511. That is, the lock mechanisms 510 and 511 are electrically short-circuited, in a state in which the plug 400 is not inserted into the plug receptacle 500.

Even in this embodiment, similar to the first embodiment of the present disclosure, as illustrated in the drawings, the sizes of the electrodes 401 and 402 and the electrodes 501 and 502 are changed, so that the plug 400 is prevented from being erroneously inserted into the plug receptacle 500.

Figure 9:
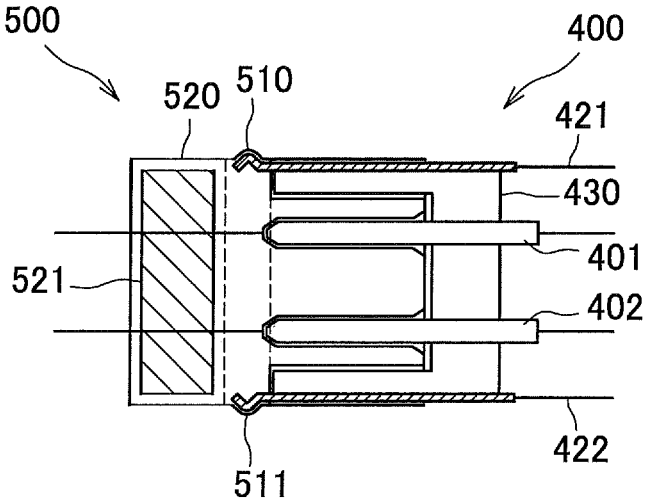
FIG. 9 is a diagram illustrating a state in which the plug 400 is inserted into the plug receptacle 500.

FIG. 9 is a diagram illustrating a state in which the plug 400 is inserted into the plug receptacle 500. As illustrated in FIG. 9, if the plug 400 is completely inserted into the plug receptacle 500, the lock detection spring electrodes 413 and 414 are locked by the lock mechanisms 510 and 511. As described above, the lock mechanisms 510 and 511 are formed of a conductive material. For this reason, if the plug 400 is completely inserted into the plug receptacle 500 and the lock detection spring electrodes 413 and 414 are locked by the lock mechanisms 510 and 511, the lock detection spring electrodes 413 and 414 are electrically short-circuited.

If the lock detection spring electrodes 413 and 414 are electrically short-circuited, insertion of the plug 400 into the plug receptacle 500 can be electrically detected, similar to the plug 100 according to the first embodiment of the present disclosure.

5. FOURTH EMBODIMENT

Configuration Example of Plug

Figure 10:
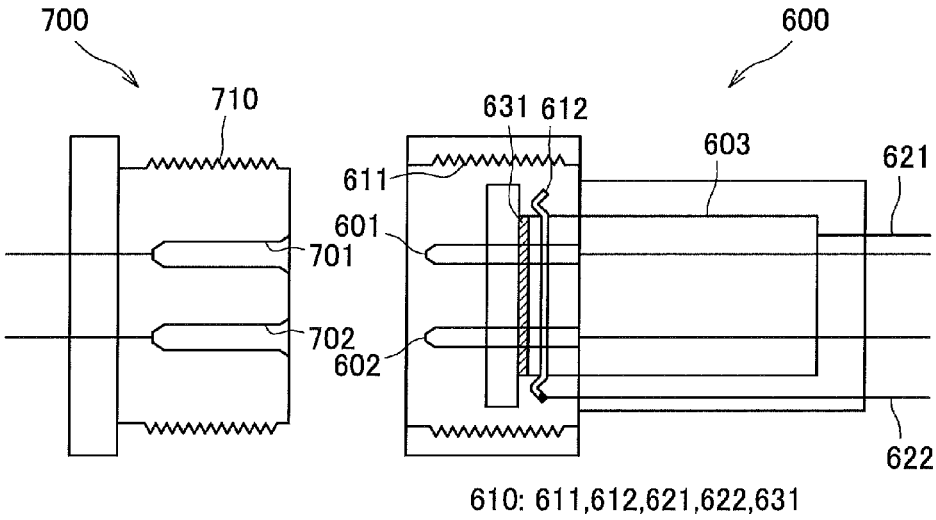
FIG. 10 is a diagram illustrating the case in which a subsystem 1100 is connected to a main system 1000.

In the fourth embodiment of the present disclosure, a configuration in which a plug and a plug receptacle are locked by a different method will be described. FIG. 10 is a diagram illustrating a structure of a plug 600 and a plug receptacle 700 provided in a bus line 2 and connected to the plug 600 in accordance with the fourth embodiment of the present disclosure.

The fourth embodiment of the present disclosure relates to the case in which the plug 600 and the plug receptacle 700 are connected and locked by a screw. The plug 600 according to the fourth embodiment of the present disclosure includes electrodes 601 and 602, a metal shell 603, and a lock mechanism 610. The lock mechanism 610 includes a screw portion 611, a spring electrode 612, lock detection leading lines 621 and 622, and an insulating material 631. The plug receptacle 700 includes electrodes 701 and 702 and a lock mechanism 710 using a screw.

Figure 11:
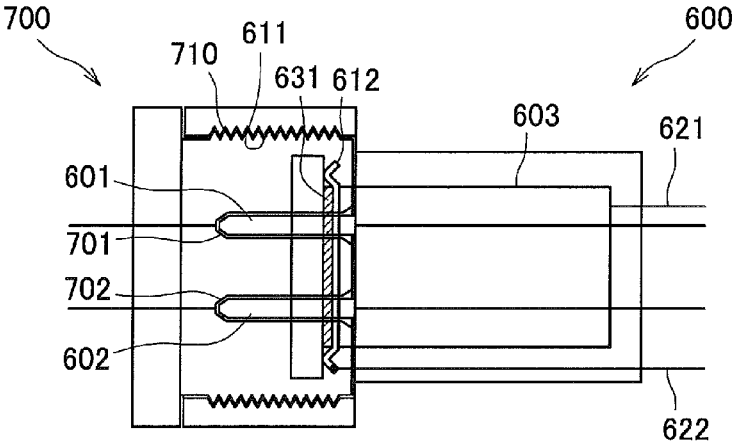
FIG. 11 is a diagram illustrating a state in which a plug 600 and a plug receptacle 700 are completely inserted.

FIG. 11 is a diagram illustrating a state in which the plug 600 and the plug receptacle 700 are completely inserted. As illustrated in FIG. 11, if the plug 600 and the plug receptacle 700 are completely inserted, the metal shell 603 is internally pressed and contacts the spring electrode 612. If the metal shell 603 contacts the spring electrode 612, the lock detection leading lines 621 and 622 are supplied with electricity and insertion of the plug 700 into the plug receptacle 800 can be electrically detected.

6. FIFTH EMBODIMENT

Configuration Example of Plug

In the above description, if the plug is inserted into the plug receptacle and is locked, the electrodes that are included in the lock detection mechanism of the plug are short-circuited and it is electrically detected that the plug is inserted into the plug receptacle and is locked. However, a method of electrically detecting that the plug is inserted into the plug receptacle and is locked is not limited to the example described above. In this embodiment, the case in which, if the plug is inserted into the plug receptacle and is locked, the electrodes included in the lock detection mechanism of the plug are opened and it is electrically detected that the plug is inserted into the plug receptacle and is locked will be described.

Figure 12:
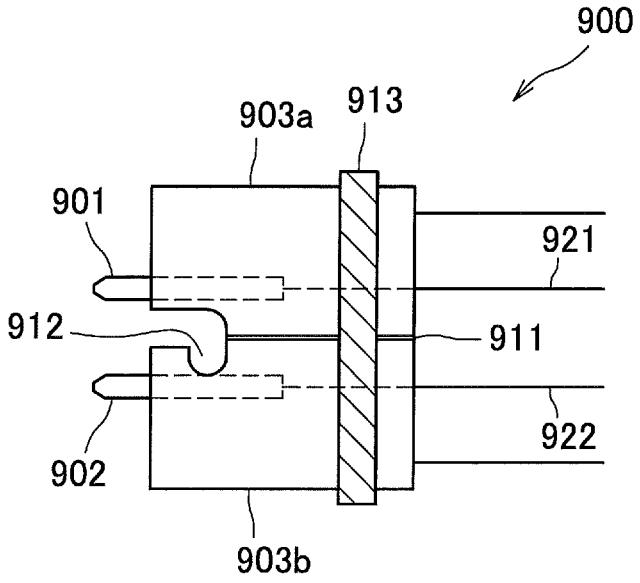
FIG. 12 is a diagram illustrating a structure of a plug 900 according to a fifth embodiment of the present disclosure.

FIG. 12 is a diagram illustrating a structure of a plug 900 according to the fifth embodiment of the present disclosure. The plug 900 according to the fifth embodiment of the present disclosure includes electrodes 901 and 902, metal shells 903*a* and 903*b*, a lock mechanism 910, and lock detection leading lines 921 and 922. The lock mechanism 910 includes a slit 911, a lock groove 912, and a spring 913. The plug 900 illustrated in FIG. 12 is inserted into the plug receptacle 200 illustrated in FIGS. 3A and 3B.

In a state in which the plug 900 illustrated in FIG. 12 is not inserted into the plug receptacle, the metal shells 903*a* and 903*b* are contacted by the spring 913. Therefore, the lock detection leading lines 921 and 922 are short-circuited. In a state in which the plug 900 illustrated in FIG. 12 is inserted into the plug receptacle and is locked, the bosses 211 and 212 of the plug receptacle 200 illustrated in FIGS. 3A and 3B separate the metal shells 903*a* and 903*b* and open the lock detection leading lines 921 and 922. If the lock detection leading lines 921 and 922 are opened, it can be electrically detected that the plug is inserted into the plug receptacle and is locked.

7. APPLICATION EXAMPLE

An application example using the plug and the plug receptacle described in the embodiments will be described. In the embodiments described above, it is assumed that the electronic apparatus such as the battery device is connected to the power line. However, the present disclosure can be applied to the case in which a power supply bus system (subsystem) to which an apparatus not including a control device is already connected is dynamically connected to a previously operated power supply bus system (main system), by using the plug and the plug receptacle described in the embodiments.

Figure 13:
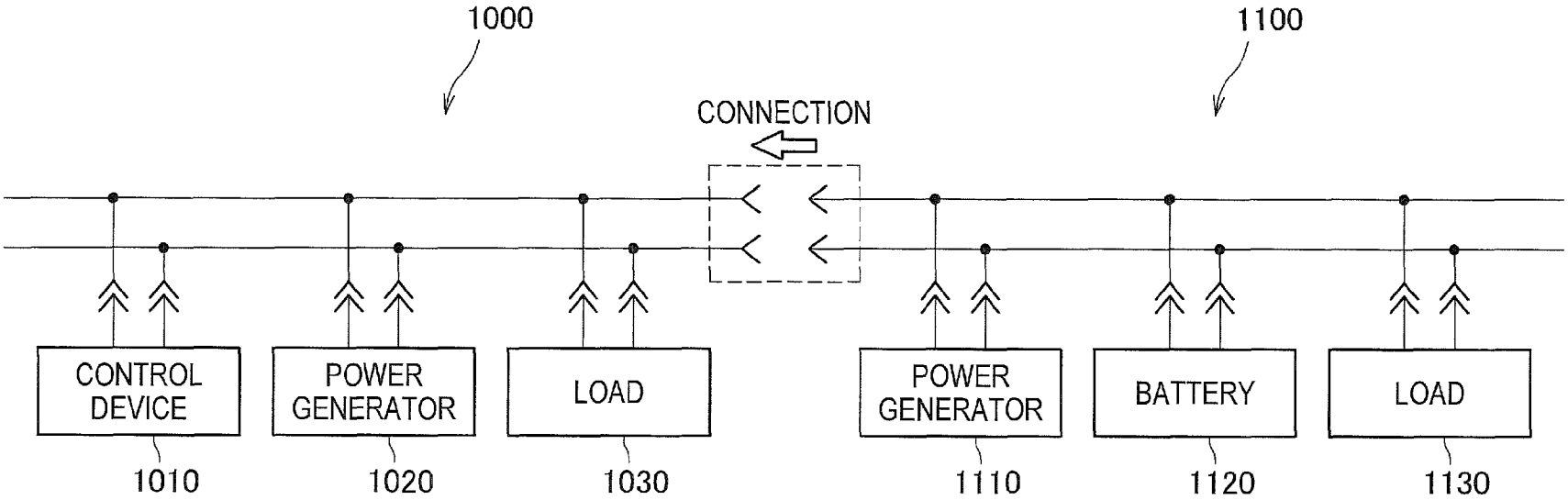
FIG. 13 is a diagram illustrating the case in which a subsystem 1100 is connected to a main system 1000.

FIG. 13 is a diagram illustrating the case in which a subsystem 1100 is connected to a main system 1000. The main system 1000 includes a control device 1010, a power generator 1020, and a load 1030 and the subsystem 1100 includes a power generator 1110, a battery 1120, and a load 1130.

As illustrated in FIG. 13, when the main system 1000 and the subsystem 1100 are formed, it is assumed that power (in particular, direct-current power) is already generated by the power generator 1020, in the main system 1000. Therefore, if the subsystem 1100 is connected to the main system 1000 using a plug and a socket to be generally used, arc may be generated at the time of connection, because mechanical electrode connection is unsure. This becomes a problem when the non-intelligent load 1130 of the subsystem 1100 is connected to the main system 1000 in particular.

Therefore, even when a plurality of power supply bus systems are connected, if the plug and the plug receptacle having the structure described in the embodiments are used, the mechanical electrode connection can be surely performed, the arc can be prevented from being generated at the time of system connection, and insertion of the plug can be electrically detected. For this reason, the control device 1010 of the main system 1000 can execute recognition processing or addressing processing with respect to each apparatus of the newly connected subsystem 1100.

8. CONCLUSION

As described above, according to each embodiment of the present disclosure, the plug and the plug receptacle that can prevent the arc from being generated between the electrodes when the apparatus is connected to the power line supplied with the direct-current power can be provided. In addition, the lock detection mechanism for electrically detecting that the plug is completely inserted into the plug receptacle and is locked is provided in the plug. By electrically detecting that the plug is completely inserted into the plug receptacle and is locked by the lock detection mechanism, the electric apparatus including the plug according to each embodiment can execute various processing using lock completion as a trigger.

It should be understood by those skilled in the art that various modifications, combinations, sub-combinations and alterations may occur depending on design requirements and other factors insofar as they are within the scope of the appended claims or the equivalents thereof.

For example, the electric apparatus that has the plug described in each embodiment of the present disclosure is not limited to the battery device 14 illustrated in FIG. 1. For example, the plug that is described in each embodiment of the present disclosure may be provided in an electric car, electric two-wheeled vehicles, or other electric vehicles driving a battery as a power source. If the plug described in each embodiment of the present disclosure is provided in the electric vehicle using the battery as the power source, the electric vehicles can electrically detect that the plug is completely inserted into the plug receptacle and is locked and can execute the various processing using the lock completion as the trigger.

Additionally, the present application may also be configured as below.

(1) A plug including:
electrodes that transmit direct-current power; and
an electrode cover that covers the electrodes,
wherein the electrode cover includes a lock detection unit that electrically detects that the electrode cover is locked to a plug receptacle including a lock mechanism after the electrode cover is completely inserted into the plug receptacle.

(2) The plug according to (1), further including:
a detection line that electrically detects that the electrode cover is locked to the plug receptacle after the electrode cover is completely inserted into the plug receptacle,
wherein the lock detection unit electrically detects that locking is performed with the detection line short-circuited, when the electrode cover is locked to the plug receptacle after the electrode cover is inserted into the plug receptacle.

(3) The plug according to (2),
wherein the electrode cover includes on an outer circumferential surface a lock groove for locking with the plug receptacle in a bayonet type, and the lock groove includes at a terminating portion a lock detection electrode to electrically detect locking with the plug receptacle.

(4) The plug according to (2) or (3), further including:
a semiconductor switch on a power line through which a current supplied by the electrode flows,
wherein the semiconductor switch is turned on when the electrode cover is locked to the plug receptacle after the electrode cover is completely inserted into the plug receptacle.

(5) The plug according to (2),
wherein the lock detection unit includes a lock detection electrode that engages with the lock mechanism of the plug receptacle, when the electrode cover is completely inserted into the plug receptacle.

(6) The plug according to (2),
wherein the electrode cover includes a screwing portion for locking with the plug receptacle by screwing and the lock detection unit includes a lock detection electrode that electrically detects that the electrode cover is locked to the plug receptacle when the electrode cover is locked to the plug receptacle by the screwing portion.

(7) The plug according to any one of (1) to (6), further including:
a detection line that electrically detects that the electrode cover is locked to the plug receptacle after the electrode cover is completely inserted into the plug receptacle,
wherein the lock detection unit electrically detects that locking is performed with the detection line opened, when the electrode cover is locked to the plug receptacle after the electrode cover is inserted into the plug receptacle.

(8) The plug according to (7),
wherein the electrode cover includes on an outer circumferential surface a lock groove formed of a conductive material and used for locking with the plug receptacle in a bayonet type, and
when the electrode cover is locked to the plug receptacle after the electrode cover is completely inserted into the plug receptacle, the detection line is opened with the electrode cover separated.

(9) An electronic apparatus including the plug according to any one of (1) to (8).

(10) The electronic apparatus according to (9), further including:
a power control unit that notices that power exchange is enabled, when the lock detection unit electrically detects that the electrode cover is locked to the plug receptacle including the lock mechanism after the electrode cover is completely inserted into the plug receptacle.

(11) The electronic apparatus according to (9),
wherein the electronic apparatus is an electric vehicle using a battery as a power source.

(12) A plug receptacle including:
electrodes that transmit direct-current power; and
an electrode cover that covers the electrodes,
wherein the electrode cover includes a lock detection mechanism that causes the plug electrically detect that a plug including a lock detection unit is locked after the plug is completely inserted into the electrode cover.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention claimed is:

1. A plug comprising:
electrodes that transmit direct-current power;
an electrode cover that covers the electrodes, wherein the electrode cover includes a lock detection unit that electrically detects that the electrode cover is locked to a plug receptacle including a lock mechanism after the electrode cover is completely inserted into the plug receptacle; and a detection line that electrically detects that the electrode cover is locked to the plug receptacle after the electrode cover is completely inserted into the plug receptacle, wherein the lock detection unit electrically detects that locking is performed with the detection line short-circuited, when the electrode cover is locked to the plug receptacle after the electrode cover is inserted into the plug receptacle, and wherein the electrode cover includes on an outer circumferential surface a lock groove for locking with the plug receptacle in a bayonet type, and the lock groove includes at a terminating portion a lock detection electrode to electrically detect locking with the plug receptacle.

2. The plug according to claim 1, further comprising:

a semiconductor switch on a power line through which a current supplied by the electrodes flows, wherein the semiconductor switch is turned on when the electrode cover is locked to the plug receptacle after the electrode cover is completely inserted into the plug receptacle.

3. The plug according to claim 1, wherein the lock detection unit includes a lock detection electrode that engages with the lock mechanism of the plug receptacle, when the electrode cover is completely inserted into the plug receptacle.

4. An electronic apparatus comprising the plug according to claim 1.

5. The electronic apparatus according to claim 4, further comprising:

a power control unit that notices that power exchange is enabled, when the lock detection unit electrically detects that the electrode cover is locked to the plug receptacle including the lock mechanism after the electrode cover is completely inserted into the plug receptacle.

6. The electronic apparatus according to claim 4, wherein the electronic apparatus is an electric vehicle using a battery as a power source.

7. A plug comprising:

electrodes that transmit direct-current power;

an electrode cover that covers the electrodes, wherein the electrode cover includes a lock detection unit that electrically detects that the electrode cover is locked to a plug receptacle including a lock mechanism after the electrode cover is completely inserted into the plug receptacle; and a detection line that electrically detects that the electrode cover is locked to the plug receptacle after the electrode cover is completely inserted into the plug receptacle, wherein the lock detection unit electrically detects that locking is performed with the detection line opened, when the electrode cover is locked to the plug receptacle after the electrode cover is inserted into the plug receptacle, wherein the electrode cover includes on an outer circumferential surface a lock groove formed of a conductive material and used for locking with the plug receptacle in a bayonet type, and when the electrode cover is locked to the plug receptacle after the electrode cover is completely inserted into the plug receptacle, the detection line is opened with the electrode cover separated.

* * * * *